United States Patent [19]

Gonzalez et al.

[11] Patent Number: 4,778,033

[45] Date of Patent: Oct. 18, 1988

[54] RESCUE DEVICE

[76] Inventors: Edwin Gonzalez, 1533 N. Claremont St., Chicago, Ill. 60622; Carlos Nieves, 2019 N. Holly St., Chicago, Ill. 60614

[21] Appl. No.: 113,517

[22] Filed: Oct. 28, 1987

[51] Int. Cl.[4] ..... A62B 37/00

[52] U.S. Cl. ..... 182/230; 182/3; 128/878

[58] Field of Search ..... 182/3, 8, 230; 128/133

[56] References Cited

U.S. PATENT DOCUMENTS

| | | | |
|---|---|---|---|
| 543,464 | 7/1895 | Brucksch | 182/8 |
| 1,073,478 | 9/1913 | Dodd | 128/133 |
| 1,490,066 | 4/1924 | Carr | 182/3 |
| 1,636,101 | 7/1927 | McLallen | 128/133 |
| 2,895,471 | 7/1959 | Rollie | 128/133 |
| 3,258,788 | 7/1966 | Anciaux | 182/3 |
| 3,297,026 | 1/1967 | Van Pelt | 128/133 |
| 3,487,474 | 1/1970 | De Meo | 182/3 |
| 4,172,453 | 10/1979 | Leckie | 128/133 |
| 4,414,969 | 11/1983 | Heyman | 128/133 |

*Primary Examiner*—Reinaldo P. Machado
*Attorney, Agent, or Firm*—Richard C. Litman

[57] ABSTRACT

An apparatus for assisting a fireman or rescue worker in gripping an immobile victim's limb or allowing an immobile person to secure his limbs around the rescuer during an emergency situation. It includes two adjustable strap members made out of nylon, an aluminum buckle attached to each strap member, and a spring closure latch disposed within one of the buckles to engage the other buckle.

4 Claims, 3 Drawing Sheets

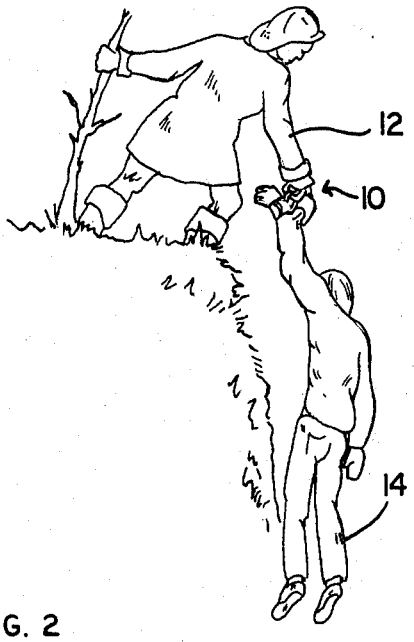
FIG. 1
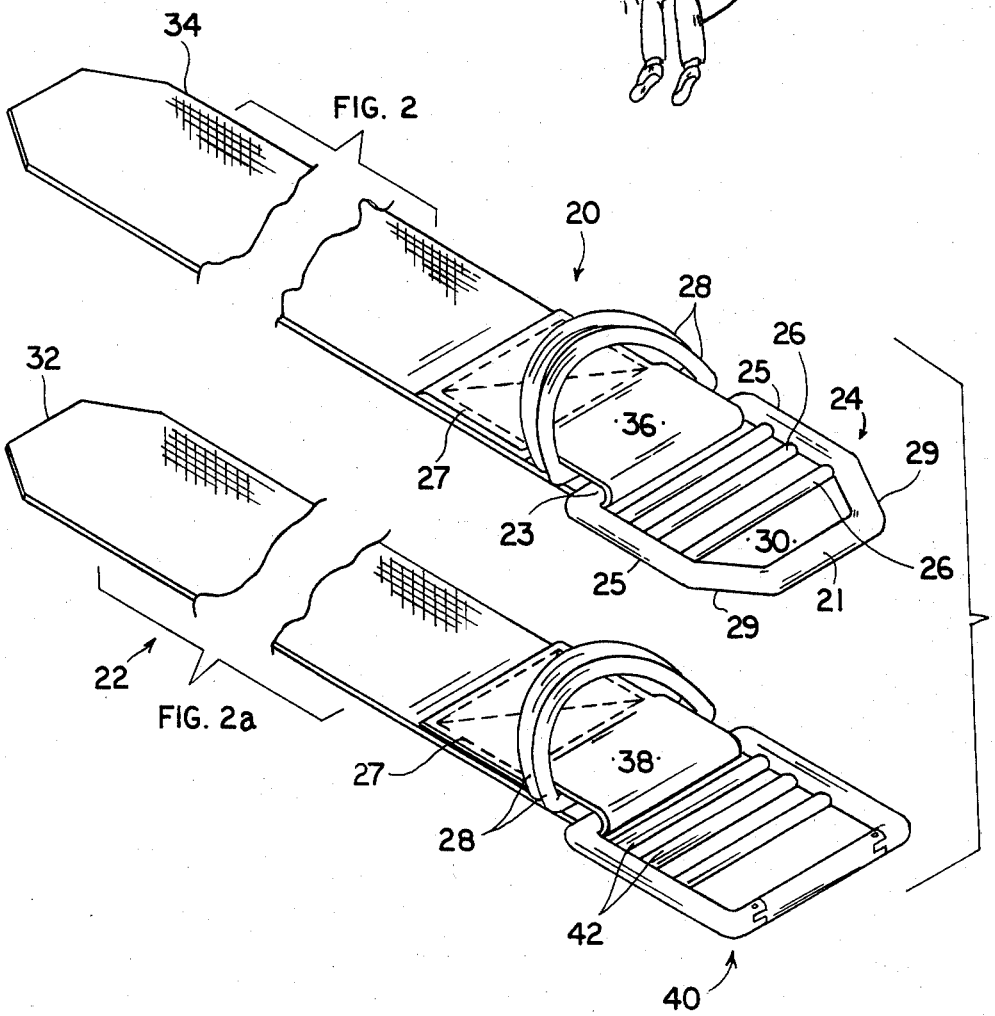

RESCUE DEVICE

FIELD OF THE INVENTION

1. Background of the Invention

The invention relates to a rescue device and, more particularly, the purpose of the invention is to assist a fireman or rescuer in gripping a victim's wrist or ankle during an emergency.

The invention further relates to an improved rescue device which provides a durable, convenient and reliable means for securing a victim's writst or ankle to a fireman, rescuer, or stable object. More particularly, the invention is directed to providing a rescue device which can be easily carried and conveniently used under emergency conditions. The device can be used to strap a victim's limb to a rescuer's limb, to a stable object such as a railing or ladder, or used to strap to both a victim's limbs so that the rescuer may remove the victim from danger by using what is commonly known as the firemen's crawl or the firemen's carry technique. The device is particularly suited for use by firemen, paramedics, lifeguards, rescue teams and the like.

The invention can be used for a variety of purposes. The method of construction of the device is more fully described herein.

2. Description of the Prior Art

Various prior art rescue devices, and the like, as well as their apparatuses and the method of their construction in general, are known and are found to be exemplary of the U.S. prior art. They are:

| U.S. Pat. No. | Inventor |
|---|---|
| 1,073,478 | J. E. Dodd |
| 1,490,066 | W. J. Carr |
| 3,297,026 | V. L. Van Pelt |
| 3,487,474 | A. J. De Meo |
| 4,172,453 | Leckie |
| 4,414,969 | Heyman |

U.S. Pat. No. 1,073,478, issued to Dodd, discloses a baby protector comprising a pair of flexible sleeves, eyes at the upper extremities of said sleeves, open center links, an adjustable back strap and a retaining device passing through said eye and adapted to suspend the back strap at a single point centrally of the back of the neck.

U.S. Pat. No. 1,490,066, issued to Carr, discloses a sling and buckle device comprising a body strap, loops, a ring suspended in one loop of said strap, a hook, a sling strap suspended at one end from the ring, and a buckle engageable with an intermediate portion of the strap and hook at will.

U.S. Pat. No. 3,487,474, issued to De Meo, discloses a belt with hand-grips comprising a belt, an elongated belt hand, coupling means and a pair of elongated flexible hand-grips being formed from a single strip.

U.S. Pat. No. 4,172,453, issued to Leckie, discloses a belt type restraint device comprising a belt for forming a girdle about the waist of a person, loops continuous with the webbing of the belt, and a single latching buckle at the back of the belt to simultaneously adjust and lock both the belt and the loops.

U.S. Pat. Nos. 4,414,969 and 3,297,026, issued to Heyman and Van Pelt respectively, disclose restraining devices comprising a long rectangular flexible member which encircles the limb, a strap having a velcro hook attached, a small ring and fastening means located at or near the end of the encircling means.

These patents or known prior uses teach and disclose various types of restraining devices and belts with hand-grip types of apparatuses of sorts and of various manufacturers, as well as their methods of construction. However, none of them, whether taken singly or in combination, disclose the specific details of the combination of the invention in such a way as to bear upon the claims of the present invention.

SUMMARY OF THE INVENTION

An object, advantage, and feature of the invention is to provide a novel rescue apparatus that is convenient in use, and lends itself to assisting a fireman or rescue worker in the removal of an immobile or disabled human from a hazardous area.

Another object of the invention is directed further to a device providing for a slip-free grip between the limb of the rescuer and the limb of the victim. This is a substantial improvement over existing devices wherein only means of restraint are provided.

Another object of the invention is to provide a mechanism which allows the rescuer to secure two of the victim's limbs around him so that he may remove the victim from danger.

Another object of the invention is to provide a novel and improved construction of a rescue device, to which the employment of adjustable straps, metal buckle and attaching latch are included and constructed of a lightweight durable material which is sturdy, compact, but yet portable.

Another object of the invention is to provide a novel and improved method of construction of a rescue device whereby a limb coupling means is incorporated therein, allowing for the safe and convenient removal of an immobile or disabled human from a hazardous area.

These together with other objects and advantages of the invention reside in the details of the process and the operation thereof, as is more fully hereinafter described and claimed. References are made to drawings as part hereof, wherein like numerals refer to like parts.

DESCRIPTION OF SEVERAL VIEWS OF THE DRAWINGS

FIG. 1 is a front perspective view of the invention illustrating a typical application of the rescue device according to a preferred embodiment and best mode of the present invention.

FIGS. 2–2*a* are front perspective views of the invention illustrating a typical construction of the rescue device according to a preferred embodiment and best mode of the present invention.

DESCRIPTION OF THE PREFERRED EMBODIMENTS OF THE INVENTION

Figure 3:
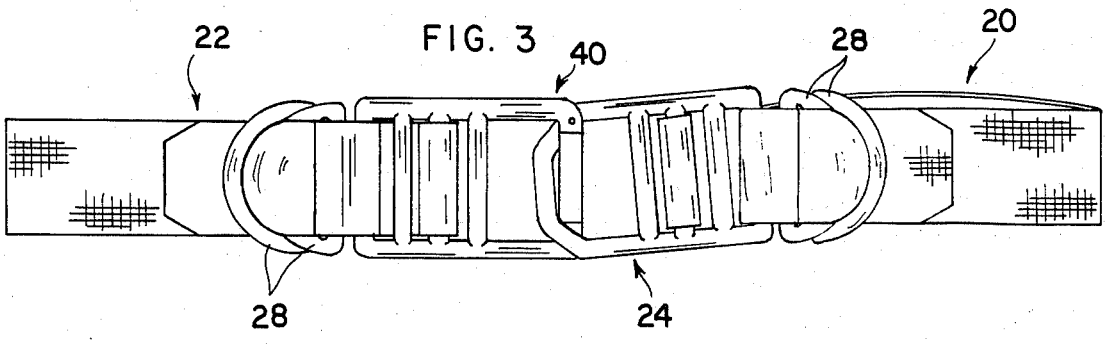
FIG. 3 is a front plan view of the invention illustrating the embodying concepts of the rescue device.
Figure 4:
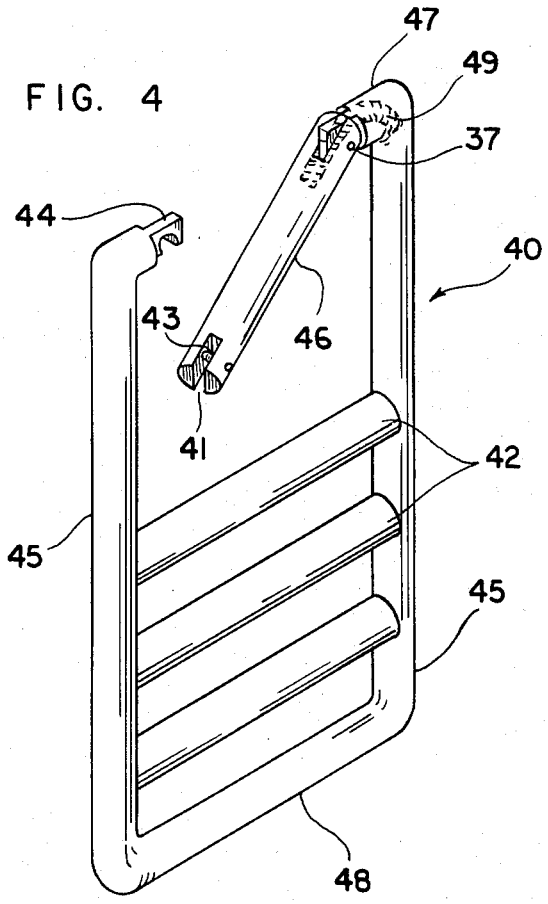
FIG. 4 is a front perspective view of the buckle containing the spring loaded latch which illustrates its construction and embodying concepts.

Referring now to the drawing, there is shown in FIG. 1 a rescue device 10 attached to the arm of a rescue worker 12 who is attempting to remove a victim or immobile person 14 from a hazardous area. The rescue device 10 may also be attached to the leg of the rescue worker 12 or the victim 14 and is most suitable for use by firemen, paramedics or other like rescue workers.

As detailed in the remaining figures, the rescue device 10 comprises a first elongated strap member 20 and a second elongated strap member 22 which are constructed out of nylon webbing or other strong material. The strap members 20 and 22 have a first end which is tapered and a second end that is looped. The second end of the strap members 20 and 22 receives metal buckle 24 and 40, respectively, and two D-shaped rings 28. The looped end 36 and 38 of strap member 20 and 22, respectively, retains the two D-shaped rings 28 and the buckles 24 and 40 in place with the stitching 27.

The metal buckles 24 and 40 are constructed of an aluminum magnesium alloy or any other suitable material which is of high strength. The metal buckle 24, which is retained on the looped end of the strap member 20, is generally hexagonal in shape having top bar 21, bottom bar 23 which receives the looped end 36 of strap member 20, side bars 25 and tapered sides 29. The buckle 24 also has a plurality of elongated bars 26 disposed therein which lie parallel to top and bottom bars 21 and 23, and between the side bars 25.

The metal buckle 40 is generally square in shape having side bars 45, top bar 47 and bottom bar 48 adapted to receive the looped end 38 of the second strap member 22. It is similar to the metal buckle 24 in that it also has a plurality of elongated bars 42 which lie parallel to its top and bottom bars, and between the side bars. However, disposed with the top bar 47 is a spring latched bar 46 which is pivotal about the pin 37 to receive the top bar 21 of the metal buckle 24. The spring latched bar 46 has a rectangular cavity 41 disposed within its first end and a spring 49 disposed within its second end. Also disposed within the top bar 47 is a latch catcher 44 adapted to receive the bar 43 which extends transverse the rectangular cavity 41. When the spring latched bar 46 is displaced to receive the metal buckle 24, the spring 49 acts to return the spring latched bar 46 to its original position such that the bar 43 is resting in the latch catcher 44 and the top bar 47 is parallel to the bottom bar 48 and the transverse bars 42.

During an emergency situation in which it is necessary for a firemen or rescue worker 12 to carry or lift an immobile person 14, the rescue device 10 can be used effectively. For example, if a person has fallen down a deep mine shaft, escaping death by hanging on to a narrow ledge. The fireman or rescue worker can lower himself to a position in which they can reach the victim. In such a traumatic situation, the palms of the victim and the rescuer may become extremely sweaty, hence it is not preferable to rely only on a victim/rescuer hand grip. Although a harness is often used in situations like this, due to time factors or victim immobility, the rescue device 10 could be used in conjunction with or opposed to a harness. The first strap member 20 is secured around the limb of the victim 14 by the rescue worker 12 such that the tapered end 34 is adjusted about the elongated bars 26, depending on the size of the limb, and secured about the two D-shaped rings 28 using a cinch. The second strap member 22 is then secured about the limb of the rescue worker 12 in the same manner. The spring latched bar 46 is then displaced downward to receive the metal buckle 24 on the first strap member 22 which is attached to the victim 14. The spring 49 then forces the latch 46 closed and the rescue worker 12 may proceed to pull the victim 14 from danger.

Figure 5:
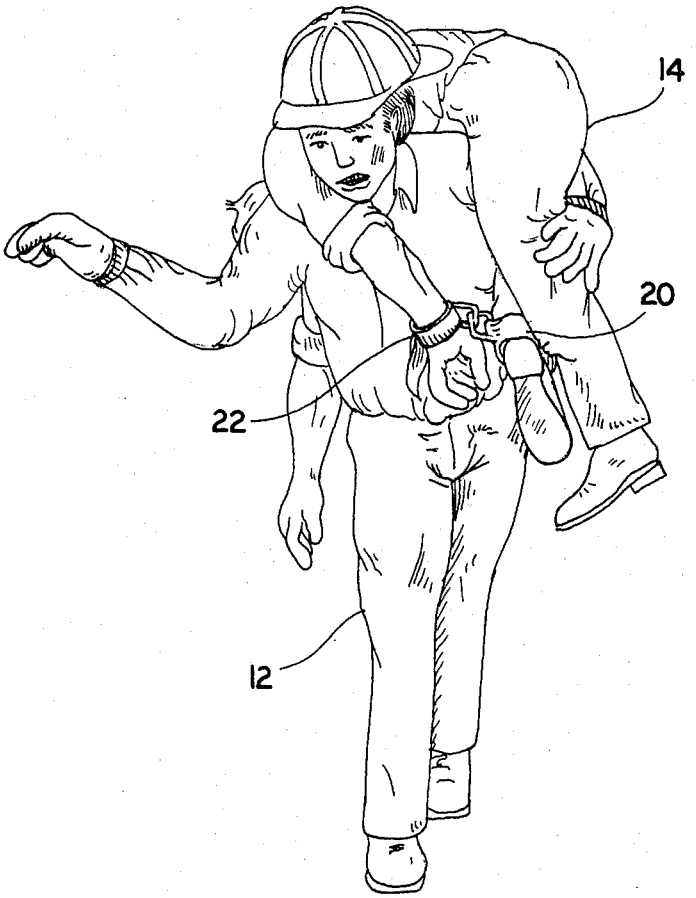
FIG. 5 is a front perspective view illustrating an alternate method of utilizing the device in conjunction with the firemen's carry technique.

The rescue driver 10 may also be used in conjunction with what is commonly known in the fire fighting trade as the firemen's crawl or the firemen's carry technique, as shown in FIG. 5. When using the firemen's carry, the rescuer 12 can secure the victim 14 around his shoulder by attaching the first strap member 20 to the victim's arm or wrist and the second strap member 22 to the opposing ankle. This allows the rescuer 12 to use one hand to further secure the victim 14 around him and to have one hand free to use as necessary.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications, and equivalents which may be resorted to, fall within the scope of the invention.

What is claimed is:

1. A rescue assisting device for use by fireman, rescuers, and the like, in the removal of immobile or disabled people from hazardous areas comprising;

elongated first and second strap members each having a first and second end, said first and second strap members selectively attachable about the limbs of a first person to be rescued and a second person doing the rescuing, said first and second strap members having fastening means therein to secure each said strap member first and second ends together respectively around the limbs of said first and second persons, attachement means for securing said first strap member to said second strap member and including means operable to allow the disengagement of said attachment means, said fastening means including a plurality of D-shaped rings adjacent one said end of each said strap member, and said attachment means including a metal buckle carried by said first end of each said strap member and having a plurality of elongated bars disposed therein for accepting said first end of said first and second strap members.

2. The apparatus of claim 1 wherein said first and second strap member is constructed of nylon webbing or like material.

3. The device of claim 1 wherein, one said buckle includes a spring latch bar engageable within the other one said buckle, said latch bar having one end pivotally connected relative its buckle and a second end provided with fastening means to secure it to its buckle, and a resilient spring connected to the pivotally connected latch bar one end and to the buckle on its other end whereby, said resilient spring allows angular displacement of said latch bar to accept the other one said buckle with said spring returning said latch bar to its original position after said displacement.

4. The device of claim 3 wherein, said buckle having said pivotally connected latch bar includes a rectangular cavity therein, and the other one said buckle includes a C-shaped cavity therein adapted to receive said latch bar of the other said buckle.

* * * * *